US010322908B2

(12) United States Patent
Haapaniemi et al.

(10) Patent No.: US 10,322,908 B2
(45) Date of Patent: Jun. 18, 2019

(54) ARRANGEMENT FOR ADJUSTING THE TAUTNESS OF A TRACTION MEMBER OF AN ELEVATOR

(71) Applicant: Kone Corporation, Helsinki (FI)

(72) Inventors: Markku Haapaniemi, Helsinki (FI); Matti Rasanen, Hyvinkaa (FI); Janne Mikkonen, Jarvenpaa (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 15/720,269

(22) Filed: Sep. 29, 2017

(65) Prior Publication Data

US 2018/0022579 A1 Jan. 25, 2018

Related U.S. Application Data

(63) Continuation of application No. PCT/FI2015/050286, filed on Apr. 27, 2015.

(51) Int. Cl.

| | |
|---|---|
| ***B66B 7/10*** | (2006.01) |
| ***B66B 11/00*** | (2006.01) |
| ***B66B 11/04*** | (2006.01) |

(52) U.S. Cl.

CPC ..... *B66B 7/10* (2013.01); *B66B 11/009* (2013.01); *B66B 11/0476* (2013.01)

(58) Field of Classification Search

CPC ..... B66B 7/10; B66B 11/009; B66B 11/0476
See application file for complete search history.

(56) References Cited

U.S. PATENT DOCUMENTS 1,132,769 A * 3/1915 Gale ..... B66B 7/062 187/264
1,894,351 A * 1/1933 Frost ..... B66B 7/10 187/412

(Continued)

FOREIGN PATENT DOCUMENTS

| | | | |
|---|---|---|---|
| CA | 2170813 | A1 | 9/1996 |
| CN | 201400508 | Y | 2/2010 |
| WO | WO-2015033017 | A1 | 3/2015 |

OTHER PUBLICATIONS

International Search Report PCT/ISA/210 for International Application No. PCT/FI2015/050286 dated Jun. 29, 2015.

(Continued)

*Primary Examiner* — Michael A Riegelman
(74) *Attorney, Agent, or Firm* — Harness, Dickey & Pierce, P.L.C.

(57) ABSTRACT

The object of the invention is an arrangement for adjusting the tautness of a traction member of an elevator, which arrangement comprises an elevator car and a compensating weight, which are for their part connected to support the elevator car by the aid of a suspension member, such as a rope or belt, and also a hoisting machine provided with a traction sheave, and one traction member, such as a belt, which is adapted to transmit the rotational movement of the traction sheave into movement of the elevator car and of the compensating weight, and also a tension control means, which is arranged to adjust the magnitude of the tension forces exerted on the suspension member and on the traction member. The arrangement comprises a tensioning means connected to the traction member, and the tension control means is connected to that part of the traction member that is on the side of the compensating weight with respect to the traction sheave, and the tensioning means is connected to (Continued)

Figure 1:
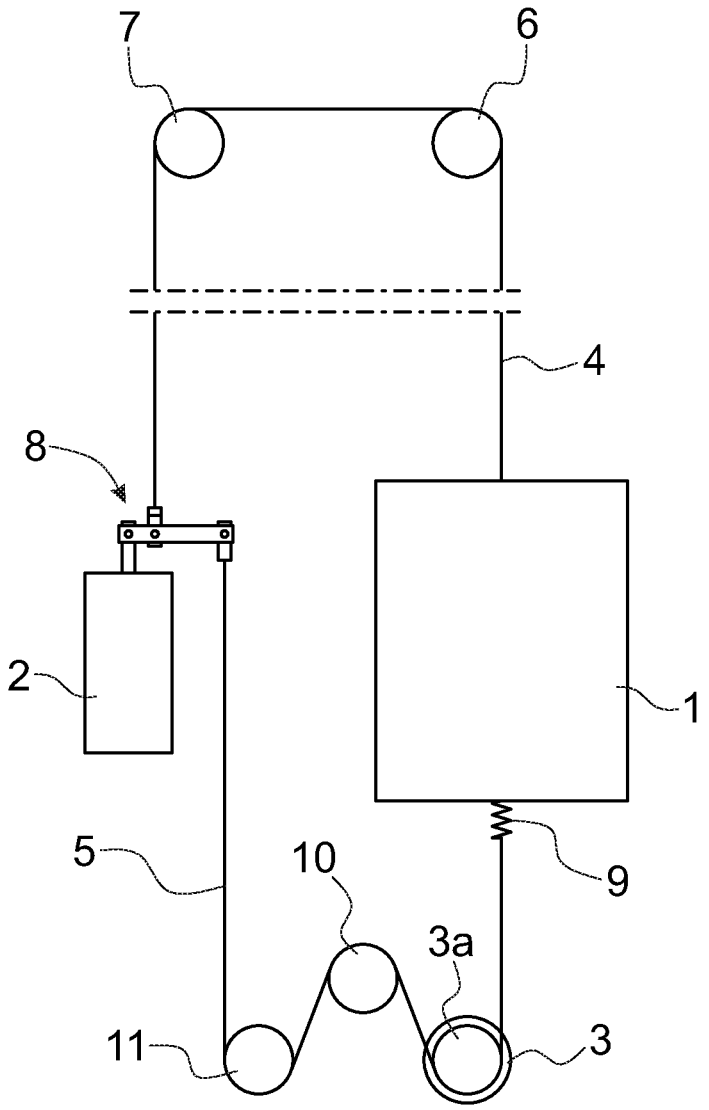

that part of the traction member that is on the side of the elevator car with respect to the traction sheave.

19 Claims, 5 Drawing Sheets

(56) References Cited

U.S. PATENT DOCUMENTS 3,882,968 A * 5/1975 Suozzo ..... B66B 7/068 187/264
5,398,781 A * 3/1995 Biewald ..... A47B 45/00 187/264
5,437,347 A 8/1995 Biewald et al.
6,193,017 B1 * 2/2001 Koster ..... B66B 7/10 187/256
6,364,063 B1 * 4/2002 Aulanko ..... B66B 11/008 187/251
6,860,367 B1 * 3/2005 Ericson ..... B66B 11/008 187/251
6,966,408 B2 * 11/2005 Sweet ..... B66B 7/068 187/254
7,806,237 B2 * 10/2010 Aulanko ..... B66B 11/08 187/264
8,235,179 B2 * 8/2012 Valjus ..... B66B 7/10 187/264
9,546,076 B2 * 1/2017 Mikkonen ..... B66B 7/021
9,643,817 B2 * 5/2017 Rasanen ..... B66B 9/00
9,758,346 B2 * 9/2017 Aulanko ..... B66B 7/10
2003/0155185 A1 * 8/2003 Nomura ..... B66B 11/009 187/266
2006/0289246 A1 * 12/2006 Aulanko ..... B66B 5/005 187/412
2016/0325965 A1 * 11/2016 Haapaniemi ..... B66B 5/0062
2017/0166419 A1 * 6/2017 Rasanen ..... B66B 19/005
2018/0022579 A1 * 1/2018 Haapaniemi ..... B66B 7/10 187/412

OTHER PUBLICATIONS

Written Opinion PCT/ISA/237 for International Application No. PCT/FI2015050286 dated Jun. 29, 2015.

* cited by examiner

ARRANGEMENT FOR ADJUSTING THE TAUTNESS OF A TRACTION MEMBER OF AN ELEVATOR

This application is a continuation of PCT International Application No. PCT/FI2015/050286 which has an International filing date of Apr. 27, 2015, the entire contents of which are incorporated herein by reference.

The object of the present invention is an arrangement as defined in the preamble of claim 1 for adjusting the tautness of a traction member of an elevator.

In some elevator arrangements the suspension members, such as the suspension ropes, of an elevator car and the traction members of the elevator car are separate from each other. Often, in this case, for practical reasons the hoisting machine is disposed on the base of the elevator hoistway, or close to the bottom part of the elevator hoistway, and e.g. toothed belts, or other belts suited to the purpose, can function as traction members, which are fitted below the elevator car and one or more compensating weights or counterweights. In this type of elevator the stresses exerted on the suspension members and on the traction members change as, among other things, the load in the elevator car changes. From the viewpoint of the proper functioning of the elevator, it is desirable for the distribution of the stresses of the suspension members and traction members to remain suitable and for the traction members to remain suitably taut. Over time elongations easily occur in traction members, especially if the travel height of the elevator is large, in which case the correct tautness is very important. Also changes in temperature affect the length of traction members. Changes in the length of traction members must be compensated in some way in order for the traction members to remain at a suitable tautness. Traction members may not be too loose nor may they be too taut because otherwise they, or other parts of the elevator, can become damaged. An apparatus or arrangement suited to the purpose is therefore needed for adjusting the tautness of the traction members of an elevator.

According to what is known in the art, the tautness of the traction members of elevators is adjusted by means of, inter alia, an arrangement functioning with an electric motor. The adjustment of the tautness can be made e.g. at certain intervals of time or on the basis of the measuring data of a separate sensor. A problem with making an adjustment at certain intervals of time is that the traction members can be at the wrong tautness for a long time between adjustments. An arrangement based on a tension sensor solves this problem, but is for its part a more complex and more expensive solution. A drawback in performing the tensioning of the traction members with an electric motor is also that this requires its own electricity supply, along with the cables and protections associated with it. The apparatus comprised in such an arrangement can also be rather large in size and heavy in weight, and if it is disposed on the elevator car it will increase the mass of the car.

U.S. Pat. No. 5,437,347 presents a solution by means of which the tautness of the traction members of an elevator is adjusted in an elevator wherein the traction members and suspension members are separate from each other. In this solution a rocker means is fixed to the counterweight or to the elevator car, to which rocker means both the suspension members and the traction members are fixed at one of their ends. The rocker means is hinged to the counterweight or to the elevator car, and the suspension members and traction members are fixed to the rocker means at different distances from its fulcrum. In this solution the counterweight of the elevator is used for maintaining the tension of the traction members and for compensating changes in their length. The solution has the problem, however, that its operating range is not very large, owing to which it is not necessarily able the keep the traction members sufficiently taut if the fluctuation range of the length of the traction members is, e.g. as a result of elongation, large. The adjustment margin for compensating elongation is thus too small in the solution described in the US patent. This can be a problem particularly in elevators with large travel heights, in which the elongations are long.

The aim of the present invention is to eliminate the aforementioned drawbacks and achieve an inexpensive and easy-to-implement arrangement in an elevator, in which the suspension members and the traction members are separate from each other, and in which arrangement the compensation of the elongation of the traction members and suspension members can be arranged to be automatic in such a way that the elevator car is all the time in balance regardless of the load or of different elongation of the suspension members and traction members, and the traction members are at a suitable tautness. The arrangement according to the invention is characterized by what is disclosed in the characterization part of claim 1. Other embodiments of the invention are characterized by what is disclosed in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

One advantage of the solution according to the invention is that by means of it the traction members of an elevator can be kept at a suitable tautness automatically in an elevator in which the traction members are separated from the suspension members. Another advantage of the solution is its large operating range, owing to which even large fluctuations in the length of the traction members can be compensated. A further advantage of the solution is that it is simple and inexpensive to implement.

Figure 2:
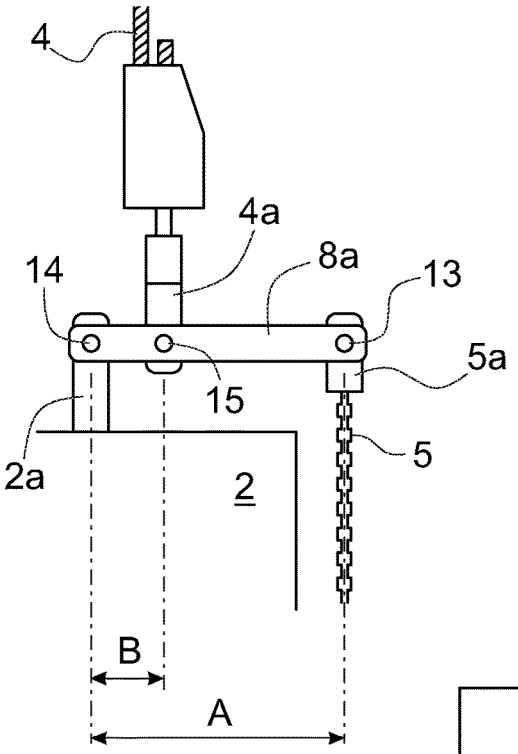
Figure 3:
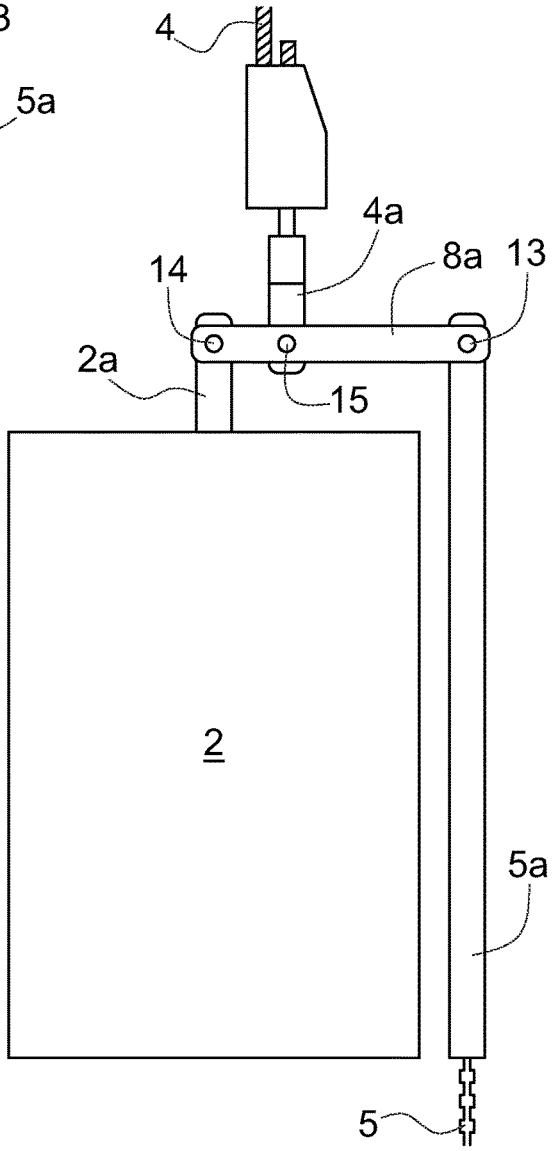
Figure 4:
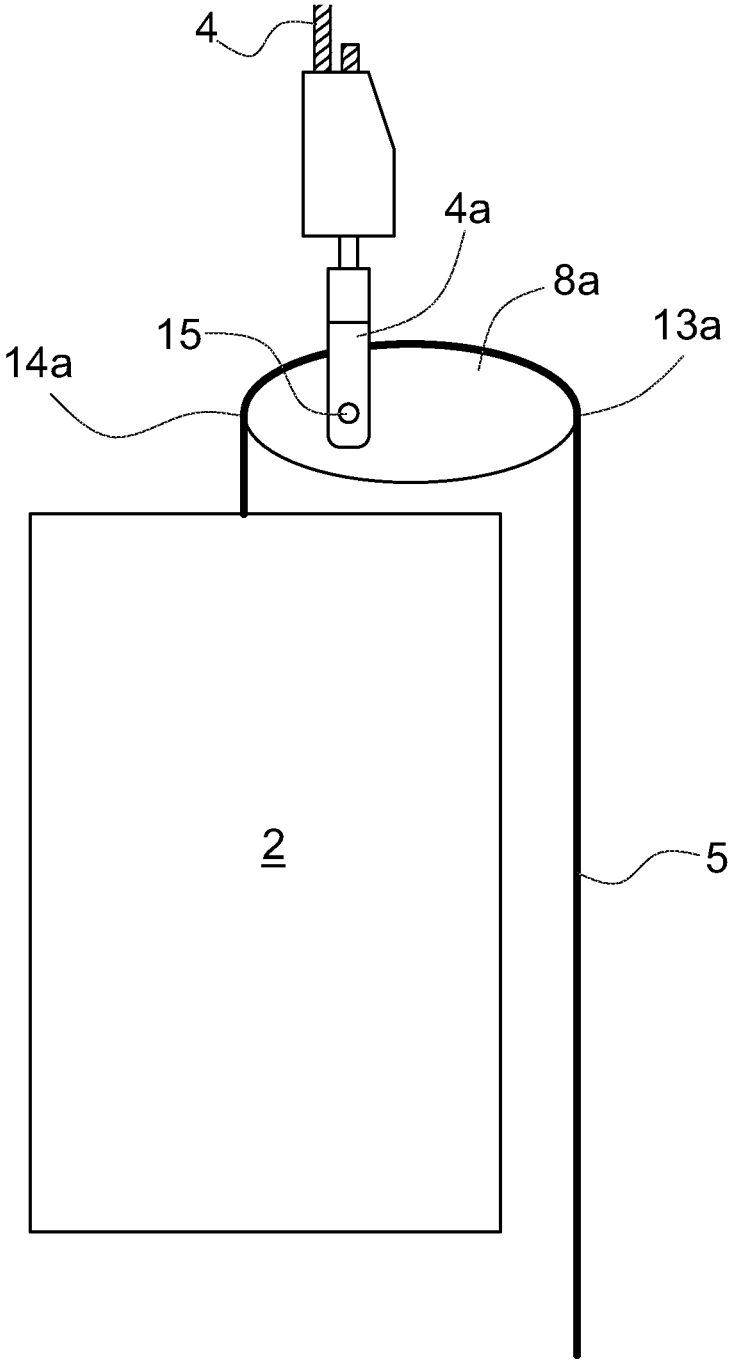
Figure 5:
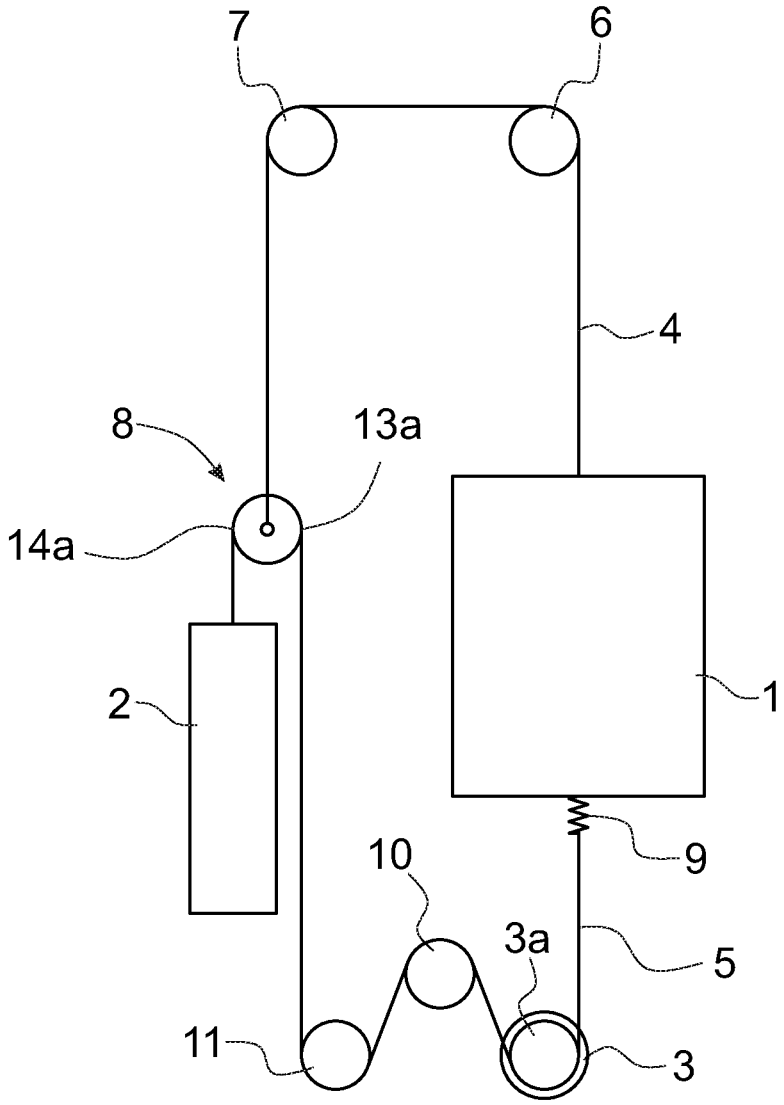
Figure 6:
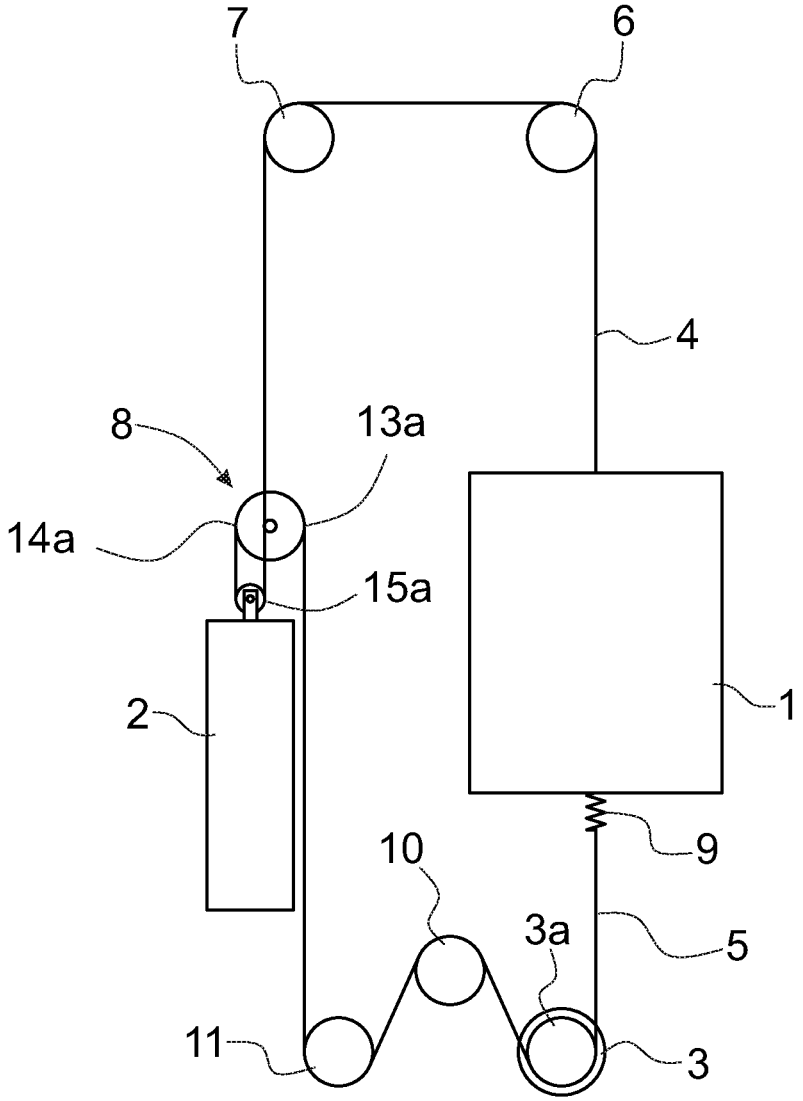

In the following, the invention will be described in more detail by the aid of some examples of its embodiment with reference to the simplified and diagrammatic drawings attached, wherein FIG. 1 presents a simplified and diagrammatic side view of an elevator having a traction ratio of 1:1, and in which one embodiment of the arrangement according to the invention is used, FIG. 2 presents a magnified side view of a rope suspension comprised in the arrangement according to the invention, at the top end of the compensating weight, FIG. 3 presents a magnified side view of a second suspension of the elevator car and of the compensating weight, said suspension comprised in the arrangement according to the invention, at the top end of the compensating weight, FIG. 4 presents a magnified side view of a third suspension of the elevator car and of the compensating weight, said suspension comprised in the arrangement according to the invention, at the top end of the compensating weight, FIG. 5 presents a simplified and diagrammatic side view of an elevator having a traction ratio of 1:1, and in which another different suspension of the elevator car and of the compensating weight is used, said suspension being comprised in the arrangement according to the invention and being at the top end of the compensating weight, and FIG. 6 presents a simplified and diagrammatic side view of an elevator having a traction ratio of 1:1, and in which yet another different suspension of the elevator car and of the compensating weight is used, said suspension being comprised in the arrangement according to the invention and being at the top end of the compensating weight.

The elevator arrangement made possible by the arrangement according to the invention comprises at least an elevator car 1 adapted to move reciprocally in an elevator hoistway and at least one or more compensating weights 2, which are for their part connected to support the elevator car 1 by means of suspension members 4, such as belts or ropes, and also by means of diverting pulleys 6 and 7 e.g. mounted on bearings in the top part of the elevator hoistway. Whenever hereinafter only one compensating weight is mentioned, the simultaneous meaning intended is one or more compensating weights, or alternatively one or more counterweights. In addition, the arrangement according to the invention comprises a hoisting machine 3 that is provided with at least one traction sheave 3*a*, or with a corresponding means, and is in a machine station disposed in the bottom part of the elevator hoistway, and at least one or more traction members 5, such as a belt or rope, which is adapted to transmit the rotational movement of the traction sheave 3*a* into linear movement of the elevator car 1 and of the compensating weight 2. Whenever hereinafter only one traction member 5 is mentioned, the simultaneous meaning intended is one or more parallel traction members, such as one or more toothed belts, V-belts, flat transmission belts or traction ropes.

The traction member 5 in the arrangement according to the invention is separated from the suspension members 4, and the traction member 5 together with the suspension members 4 and elevator car 1 and compensating weight 2 form an essentially closed loop in which the tautness of at least the traction member 5 is monitored and the tautness is kept at the desired level independently of different loads and elongations. Characteristic to the invention, and common to all the different embodiments of the invention, is that the compensating weight 2 is connected e.g. by means of a traction member 5 provided with essentially spring tensioning or constant-force tensioning to the elevator car 1 via the hoisting machine 3.

FIGS. 1 and 2 present a simplified and diagrammatic side view of an elevator in which one embodiment of the solution according to the invention is used. FIG. 2 presents a magnified view of the suspension solution according to FIG. 1 at the top end of the compensating weight 2. The elevator comprises at least an elevator car 1 and at least one compensating weight 2, as well as a hoisting machine 3 plus traction sheave 3*a* arranged to move the elevator, a suspension member 4 and a traction member 5. There can be one suspension member 4 and traction member 5 or a number of them side by side. The suspension member 4 is fixed at its first end to the top part of the elevator car 1, from where it is guided upwards to pass around the top of the diverting pulleys 6 and 7 disposed in the top part of the elevator hoistway. After having passed around the top of the diverting pulley 7 the suspension member 4 is led downwards to a tension control means 8 fitted near the compensating weight 2, to which tension control means the suspension member 4 is fixed at its second end.

The traction member 5 is fixed at its first end to a tensioning means 9 that is on the bottom part of the elevator car 1 and provides a constant tensioning force, from where the traction member 5 is led downwards to the hoisting machine 3. The traction member 5 is arranged to pass around the bottom of the traction sheave 3*a* of the hoisting machine 3, after which over the first diverting pulley 10 and onwards under the second diverting pulley 11, from where upwards to the tension control means 8, to which the traction member 5 is fixed at its second end. The traction member 5 is e.g. a toothed belt, in which case on the traction sheave 3*a* is toothing that matches the toothing of the traction member 5. The compensating weight 2 is fixed at its lifting point to the tension control means 8 by the aid of its own fixing means 2*a*.

The tension control means 8 is a means that functions as a lever, having e.g. a bar-shaped or rod-shaped frame part 8*a*, the traction member 5 of the elevator being fixed at its second end to the fixing point 13 at the first end of said frame part via a fixing means 5*a*, and the compensating weight 2 being fixed at its lifting point to the fixing point 14 at the second end of said frame part via a fixing means 2*a*. The suspension member 4 is fixed at its second end via a fixing means 4*a* to a suitable fixing point 15 between the fixing points 13 and 14, to between the first and second end of the frame part 8*a* of the tension control means 8. The fixing means 2*a*, 4*a* and 5*a* are fixed to the fixing points 13, 14 and 15 on the frame part 8*a*, e.g. via hinges or shaft extensions suited to the purpose.

The fixing point 15 of the fixing means 4*a* of the suspension member 4 between the fixing points 13 and 14 is selected in such a way that between the suspension member 4 and the traction member 5 the correct lever ratio A/B is obtained, in which lever ratio the length of the lever arm A is the distance of the fixing point 13 of the traction member 5 of the elevator from the fixing point 14 of the compensating weight 2, and the length of the lever arm B is the distance of the fixing point 15 of the suspension member 4 of the elevator from the fixing point 14 of the compensating weight 2. This lever ratio A/B acts directly on the magnitude of the forces exerted on the suspension member 4 and on the traction member 5.

FIG. 3 presents a suspension solution and tension control solution that is otherwise similar to those in FIGS. 1 and 2, but in this solution the fixing means 5*a* of the traction member 5 is longer than that in the solution presented by FIGS. 1 and 2 and extends from its fixing point 13 downwards to the level of the bottom edge of the compensating weight 2 or to near the bottom edge. One advantage in this case is the easy fixing of the second end of the traction member 5 to the fixing means 5*a*, in which case installation and servicing of the elevator arrangement is made easier in this respect.

FIG. 4 presents a magnified side view of one third suspension of the elevator car 1 and of the compensating weight 2, said suspension comprised in the arrangement according to the invention, at the top end of the compensating weight 2. Instead of a rod-shaped frame part disposed above the top end of the compensating weight 2, the tension control means 8 now comprises a frame part 8*a* having at least a top part of curved shape, which as viewed from the side is e.g. roughly elliptical in shape and has a longer horizontal axis than vertical axis. In this solution not so many joints or other components are needed as in the solution according to FIGS. 1 and 2. The traction member 5 is adapted to pass from the first end of the frame part 8 along the top surface of the frame part to the second end of the frame part and from there downwards to the top surface of the compensating weight 2, to which the second end of the traction means 5 is fixed. The top surface of the frame part 8*a* is preferably toothed when the traction member is a toothed belt. Between the first and second end of the traction member 8*a*, a fixing means 4*a* of the suspension member 4 is hinged to a suitable fixing point 15 from each end of said traction member. The fixing point 15 is selected, as stated earlier, in such a way that the desired lever ratio A/B is obtained between the suspension member 4 and the traction member 5, in which ratio the length of the lever arm A is the distance between the lifting point of the compensating weight 2 and the traction member 5 at the point 13*a*, where the traction member 5 detaches from the first end of the frame part 8*a* and descends to the machine station, and the length of the lever arm B is the distance between the lifting point of the compensating weight 2 and the fixing point 15 of the suspension member 4. This lever ratio A/B acts directly, in the manner presented above, on the magnitude of the forces exerted on the suspension members 4 and on the traction member 5.

FIG. 5 presents a simplified and diagrammatic side view of an elevator in which a further embodiment of the solution according to the invention is used. In this embodiment the layout of the elevator as well as the fixings and paths of passage of the suspension member 4 and traction member 5 are in other respects similar to those in the elevator according to FIG. 1, except for the fixing of the second end of the suspension member 4 and of the traction member 5. In this embodiment a diverting pulley 16 fitted above the compensating weight 2 functions as the tension control means 8, over which diverting pulley the traction member 5 is arranged to pass to the compensating weight 2, to the top part of which the traction member 5 is fixed at its second end. Correspondingly, the second end of the suspension member 4 is fixed in connection with the shaft of the diverting pulley 16. In this embodiment the ratio of the tension forces exerted on the suspension members 4 and on the traction member 5, i.e. the lever ratio A/B, is 2:1.

FIG. 6 presents a simplified and diagrammatic side view of an elevator in which yet another embodiment of the solution according to the invention is used. In this embodiment also the layout of the elevator as well as the fixings and paths of passage of the suspension members 4 and traction member 5 are in other respects similar to those in the elevator according to FIG. 1, except for the fixing of the second end of the suspension member 4 and of the traction member 5. In this embodiment two diverting pulleys 17 and 18 fitted above the compensating weight 2 function as the tension control means 8. In this embodiment the ratio of the tension forces exerted on the suspension members and on the traction members, i.e. the lever ratio A/B, can be adjusted to that desired by selecting the diameters of the diverting pulleys 17 and 18 suitably.

The detachment points 13*a* and 14*a* of the traction member 5 presented in FIGS. 4-6 from the tension control means 8 and the detachment point 15*a* of the suspension member 4 from the suspension member 8 correspond in their functions to the fixing points 13, 14 and 15 presented in FIGS. 2 and 3.

In the arrangement according to the invention the traction member 5 is fixed at one of its ends, e.g. at the end on the elevator car 1 side, with a fixing means 9 providing a spring force or a constant-tensioning force in such a way that the traction member 5 always remains sufficiently taut on the rim of the traction sheave 3*a* and that when the suspension members 4 of the elevator car 1 stretch and loosen, the fixing means 9 removes the elongation produced via the traction member 5 and the suspension of the suspension members 4 compensates the elongation by the aid of the tension control means 8 by keeping the elevator car 1 always on an even bearing.

The tensioning means 9 can also be disposed elsewhere than on the bottom part of the elevator car 1, depending on the suspension ratio. For example, when the traction ratio of the elevator car 1 is 2:1, below the elevator car 1 is e.g. a diverting pulley, and the traction member 5 is led from the traction sheave 3*a* over the top of said diverting pulley back downwards either to the floor of the elevator hoistway or to the elevator machine station, to which the first end of the traction member 5 is fixed via a tensioning means 9 providing a constant tensioning force.

It should also be noted that the different solutions presented above can be inventive features together with one or more other features of the invention.

Characteristic to the solution according to the invention is, inter alia, that tensioning of the traction member 5 is arranged on both sides of the traction sheave 3*a*, i.e. at the first end of the traction member 5 on the elevator car 1 side as well as at the second end of the traction member 5 on the compensating weight 2 side. At the first end of the traction member 5 in connection with the elevator car 1 is a tensioning means 9 providing a constant tensioning force, and at the second end of the traction member 5 in connection with the compensating weight 2 is a tension control means 8 enabling an adjustable lever ratio A/B.

The size of the tension control means 8, e.g. the length and position of the frame part 8*a* or the diameters of the diverting pulleys 16, 17, is selected in such a way that, in addition to achieving the desired lever ratio based on the masses of the compensating weight 2, elevator car 1 and load, also the traction member 5 can be disposed in a suitable location beside the compensating weight 2 on a line on which the traction member 5 is guided to travel to the diverting pulley 11 past the compensating weight 2. In this case the point 13, 13*a* connected to the tension control means 8 of the traction member 5 is, as viewed from above, disposed outside the area of travel formed by the cross-section of the compensating weight 2. This solution allows easier variation of the layout of the elevator.

In the solution according to the invention the tensioning forces exerted on the suspension members 4 and on the traction member 5 are smaller than with tensioning systems according to prior art and, in addition, elongations are smaller and the lever ratio automatically compensates elongations in the suspension members 4 and traction member 5. This is based on the fact that in the structure according to the invention, a force that is larger than that which comes from the combination of the lever ratio and gravity is not produced in the suspension members 4 and traction member 5. Tensioning systems that are known in the art always have more force in order to function sufficiently well.

It is obvious to the person skilled in the art that the invention is not limited solely to the examples described above, but that it may be varied within the scope of the claims presented below. Thus, for example, the suspension solutions and the structural solutions for the tension control means can also be different to what is presented above.

The invention claimed is:

1. An arrangement to adjust a tautness of a traction member of an elevator, the arrangement comprising:

an elevator car adapted to move reciprocally in an elevator hoistway; and a compensating weight connected to the elevator car via at least one suspension member to support the elevator car;

a hoisting machine including at least one traction sheave and at least one traction member configured to transmit rotational movement of the traction sheave into movement of the elevator car and of the compensating weight, the traction member including a first end and a second end, the traction member being wound about the traction sheave such that one portion of the traction member is on a side of the elevator car with respect to the at least one traction sheave;

a tension control device connected to the suspension member and the traction member, the tension control device configured to adjust a magnitude of tension forces exerted on the suspension member and on the traction member when the tension forces are within an operating range, the suspension member includes a first end and a second end; and a tensioning device connected between the elevator car and the first end of the traction member such that the tensioning device is connected to only the one portion of the traction member on the side of the elevator car with respect to the at least one traction sheave and adjusts the tautness of the traction member to increase the operating range of the tension control device.

2. The arrangement according to claim 1, wherein the tension control device is a fixing point of the second end of the traction member, the fixing point associated with the second end of the traction member being a first horizontal distance from a fixing point of the compensating weight, and the tension control device is a fixing point of the second end of the suspension member, the fixing point associated with the second end of the suspension member being a second horizontal distance from the fixing point of the compensating weight, the second horizontal distance being smaller than or equal to the first horizontal distance.

3. The arrangement according to claim 2, wherein the traction member is configured to travel to the compensating weight over the tension control device and detach from the tension control device at a first detachment point and running to the elevator car and a second detachment point and running to the compensating weight such that the first detachment point is relatively closer to the elevator car than the second detachment point and the second detachment point is relatively closer to a lifting point of the compensating weight than the first detachment point, and a lever ratio of the tension control device is defined by a distance from the lifting point to the first detachment point over a distance from the lifting point to the second detachment point.

4. The arrangement according to claim 1, wherein at the tension control device is configured to divide forces acting on the traction member and on the suspension member based on a lever ratio.

5. The arrangement according to claim 1, wherein the tension control device includes a fixing point of the second end of the suspension member, the fixing point of the suspension member in the tension control device being between a fixing point of the compensation weight and the fixing point associated with the second end of the traction member in a horizontal direction.

6. The arrangement according to claim 1, wherein the first end of the traction member is fixed to the elevator car via a spring providing a constant tensioning force and the second end of the traction member is connected to the tension control device that distributes the tension forces to both the suspension member and the traction member based on a lever ratio.

7. The arrangement according to claim 1, wherein the tension control device has a rod-shaped frame part, the rod-shaped frame part having a first end that includes a fixing point associated with the second end of the traction member and a second end having a fixing point associated with the compensating weight such that, between the first end and the second end of the rod-shaped frame part is a fixing point associated with the second end of the suspension member.

8. The arrangement according to claim 7, wherein the traction member, the compensating weight and the suspension member are connected to their respective fixing points via a shaft extension or hinge.

9. The arrangement according to claim 1, wherein, as viewed from above, a fixing point associated with connecting the second end of the traction member to the tension control device is disposed outside an area of travel formed by a cross-section of the compensating weight.

10. The arrangement according to claim 1, wherein the tension control device is a diverting pulley, over which the traction member is lead to travel from the elevator car to the compensating weight, the diverting pulley including a shaft connected to the second end of the suspension member.

11. An arrangement to adjust a tautness of a traction member of an elevator that includes a suspension member that is separate from the traction member, each of the traction member and the suspension member having a first end and a second end, the arrangement comprising:

a tension control device connected to the suspension member and the second end of traction member, the tension control device configured to adjust a magnitude of tension forces exerted on the suspension member and on the traction member when the tension forces are within an operating range; and a tensioning device connected between the elevator and the first end of the traction member, the tensioning device configured to provide a constant tensing force between the elevator and a hoisting machine such that the tensioning device is connected to only one portion of the traction member on a side of the elevator with respect to at least one traction sheave and adjusts the tautness of the traction member to increase the operating range of the tension control device.

12. The arrangement of claim 11, wherein the second end of the suspension member is connected to the tension control device and the first end of the suspension member is connected to a top of the elevator, the tensioning device is connected between a bottom of the elevator and the first end of the traction member, and the second end of the traction member is connected to the tension control device.

13. The arrangement of claim 12, wherein the traction member, the suspension member the elevator and a compensating weight form a closed loop, and the tension control device is configured to maintain the tautness of at least the traction member in the closed loop independent of a load of the elevator.

14. The arrangement according to claim 11, wherein the tensioning device is configured to provide the constant tensioning force between the hoisting machine and the first end of the traction member.

15. The arrangement according to claim 11, wherein the tension control device is configured to adjust the magnitude of the tensioning forces based on a lever ratio associated with the tension control device.

16. The arrangement according to claim 15, wherein the tension control device includes a first point associated with a compensating weight, a second point associated with the suspension member and a third point associated with the traction member, the second point being arranged between the first point and the third point.

17. The arrangement according to claim 16, wherein the lever ratio associated with the tension control device is a ratio of a distance between the first point and the third point over a distance between the first point and the second point.

18. The arrangement according to claim 16, wherein the first point and the third point are points at which the traction member detaches from a curved frame of the tension control device.

19. The arrangement according to claim 15, wherein, based on the lever ratio, the tension control device automatically compensates for elongations in the suspension member and the traction member.

* * * * *